US008714697B2

(12) United States Patent
Dumas et al.

(10) Patent No.: US 8,714,697 B2
(45) Date of Patent: May 6, 2014

(54) PUMPING CAP FOR APPLYING SUCTION TO PRINTHEAD

(75) Inventors: Randolph E. Dumas, Brockport, NY (US); Gary Alan Kneezel, Webster, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 13/596,195

(22) Filed: Aug. 28, 2012

(65) Prior Publication Data

US 2014/0063119 A1 Mar. 6, 2014

(51) Int. Cl.
*B41J 2/165* (2006.01)

(52) U.S. Cl.
CPC ..... *B41J 2/16532* (2013.01); *B41J 2/16511* (2013.01)
USPC ..... 347/30

(58) Field of Classification Search
CPC ..... B41J 2/16505
USPC ..... 347/30
See application file for complete search history.

(56) References Cited

U.S. PATENT DOCUMENTS

| | | | | |
|---|---|---|---|---|
| 4,045,802 | A * | 8/1977 | Fukazawa et al. | 347/29 |
| 5,117,244 | A * | 5/1992 | Yu | 347/29 |
| 5,420,619 | A * | 5/1995 | Glassett et al. | 347/30 |
| 5,534,896 | A | 7/1996 | Osborne | |
| 6,609,779 | B2 | 8/2003 | Davis | |
| 6,793,316 | B2 | 9/2004 | Sugimura et al. | |
| 7,350,902 | B2 | 4/2008 | Dietl et al. | |
| 7,988,255 | B2 | 8/2011 | Balcan et al. | |
| 2006/0284926 | A1 * | 12/2006 | Ballard et al. | 347/30 |
| 2012/0237377 | A1 * | 9/2012 | Richardt et al. | 417/473 |

FOREIGN PATENT DOCUMENTS

| | | | |
|---|---|---|---|
| JP | 62113556 | A * | 5/1987 |
| JP | 10138514 | A * | 5/1998 |

* cited by examiner

*Primary Examiner* — Shelby Fidler
(74) *Attorney, Agent, or Firm* — Peyton C. Watkins

(57) ABSTRACT

An inkjet printer includes an inkjet printhead including nozzles disposed in a printhead face; a cap including: a base; and a sealing face for sealing around the printhead face, wherein suction is generated at the printhead face for priming the nozzles when the base is moved from a first position to a second position, wherein the first position is located a smaller distance from the sealing face than the second position; and a valve having an open position and a closed position, wherein the valve is configured to be in the open position when the base of the cap is moved from the second position to the first position for relieving excess pressure in the cap.

14 Claims, 12 Drawing Sheets

FIG. 5 – Prior Art

PUMPING CAP FOR APPLYING SUCTION TO PRINTHEAD

CROSS REFERENCE TO RELATED APPLICATIONS

Reference is made to commonly assigned, co-pending U.S. patent application Ser. No. 13/596,202, concurrently filed herewith, entitled "Method of Maintaining an Inkjet Printhead" by Randolph Dumas et al, the disclosure of which is herein incorporated by reference.

FIELD OF THE INVENTION

This invention relates generally to the field of printhead maintenance in an inkjet printer, and more particularly to configurations of a cap for applying suction to the nozzles of an inkjet printhead.

BACKGROUND OF THE INVENTION

An inkjet printing system typically includes one or more printheads and their corresponding ink supplies. A printhead includes an ink inlet that is connected to its ink supply and an array of drop ejectors, each ejector including an ink pressurization chamber, an ejecting actuator and a nozzle through which droplets of ink are ejected. The ejecting actuator may be one of various types, including a heater that vaporizes some of the ink in the chamber in order to propel a droplet out of the nozzle, or a piezoelectric device that changes the wall geometry of the ink pressurization chamber in order to generate a pressure wave that ejects a droplet. The droplets are typically directed toward paper or other print medium (sometimes generically referred to as recording medium or paper herein) in order to produce an image according to image data that is converted into electronic firing pulses for the drop ejectors as the print medium is moved relative to the printhead.

Motion of the print medium relative to the printhead can consist of keeping the printhead stationary and advancing the print medium past the printhead while the drops are ejected. This architecture is appropriate if the nozzle array on the printhead can address the entire region of interest across the width of the print medium. Such printheads are sometimes called pagewidth printhead nozzle array is somewhat smaller than the extent of the region of interest for printing on the print medium and the printhead is mounted on a carriage. In a carriage printer, the print medium is advanced a given distance along a print medium advance direction and then stopped. While the print medium is stopped, the printhead carriage is moved in a carriage scan direction that is substantially perpendicular to the print medium advance direction as the drops are ejected from the nozzles. After the carriage has printed a swath of the image while traversing the print medium, the print medium is advanced, the carriage direction of motion is reversed, and the image is formed swath by swath.

Inkjet ink includes a variety of volatile and nonvolatile components including pigments or dyes, humectants, image durability enhancers, and carriers or solvents. A key consideration in ink formulation and ink delivery is the ability to produce high quality images on the print medium. Image quality can be degraded if air bubbles block the small ink passageways from the ink supply to the array of drop ejectors. Such air bubbles can cause ejected drops to be misdirected from their intended flight paths, or to have a smaller drop volume than intended, or to fail to eject. Air bubbles can arise from a variety of sources. Air that enters the ink supply through a non-airtight enclosure can be dissolved in the ink, and subsequently be exsolved (i.e. come out of solution) from the ink in the printhead at an elevated operating temperature, for example. Air can also be ingested through the printhead nozzles. For a printhead having replaceable ink supplies, such as ink tanks, air can also enter the printhead when an ink tank is changed.

In a conventional inkjet printer, a part of the printhead maintenance station is a cap that is connected to a suction pump, such as a peristaltic or tube pump. The cap surrounds the printhead nozzle face during periods of nonprinting in order to inhibit evaporation of the volatile components of the ink. Periodically, the suction pump is activated to prime the printhead, removing some ink and unwanted air bubbles from the nozzles. The pump can be powered by a dedicated motor or by a motor, such as the media advance motor, that has other functions as well. A dedicated motor results in additional cost and takes up additional space in the printer. Prior art pumps driven from the media advance motor, such as those described in U.S. Pat. No. 7,988,255 and U.S. Pat. No. 6,793,316, are configured such that a gear train with a fairly large number of gears is needed for power transmission. Such a gear train can cause additional noise during operation, and requires additional drive power from the motor in order to turn the gears. In addition, it can take ten seconds or more to generate sufficient suction to prime a printhead using a tube pump. Printing is delayed until priming is completed.

U.S. Pat. No. 5,534,896 discloses a tubeless printhead priming cap having a rolling diaphragm defining a chamber with the diaphragm being reciprocated by a spring-returned lever having a piston on one end. After the piston decreases the volume of the chamber, the priming cap is brought into sealing engagement with the printhead. A subsequent downstroke of the piston causes the volume of the chamber to expand, thereby producing a vacuum within the chamber for priming the printhead. To empty the chamber, the cap is rotated to an ink blotter for removing accumulated ink. Such a removal mechanism for accumulated ink adds undesirable complexity to the priming system.

Consequently, a need exists for an inkjet printer cap and pump having low cost, low operational noise, rapid generation of suction and a simple way of removing waste ink that has accumulated in the cap.

SUMMARY OF THE INVENTION

The present invention is directed to overcoming one or more of the problems set forth above. Briefly summarized, according to one aspect of the invention, the invention resides in an inkjet printer comprising an inkjet printhead including nozzles disposed in a printhead face; a cap including: a base; and a sealing face for sealing around the printhead face, wherein suction is generated at the printhead face for priming the nozzles when the base is moved from a first position to a second position, wherein the first position is located a smaller distance from the sealing face than the second position; and a valve having an open position and a closed position, wherein the valve is configured to be in the open position when the base of the cap is moved from the second position to the first position for relieving excess pressure in the cap.

These and other objects, features, and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the detailed description of the preferred embodiments of the invention presented below, reference is made to the accompanying drawings, in which.

DETAILED DESCRIPTION OF THE INVENTION

The present description will be directed in particular to elements forming part of, or cooperating more directly with, apparatus in accordance with the present invention. It is to be understood that elements not specifically shown or described may take various forms well known to those skilled in the art.

Figure 1:
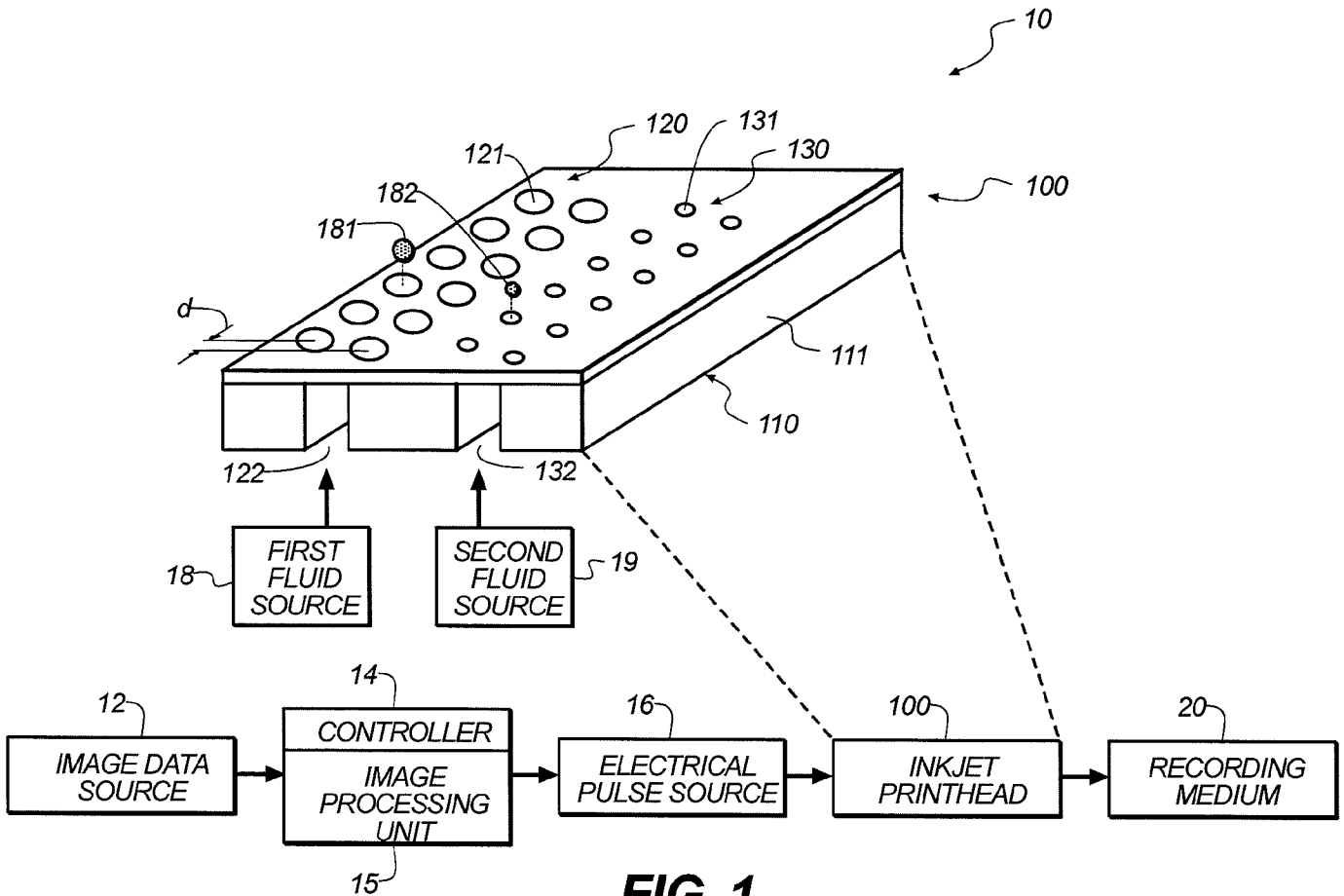
FIG. 1 is a schematic representation of an inkjet printer system.

Referring to FIG. 1, a schematic representation of an inkjet printer system 10 is shown, for its usefulness with the present invention and is fully described in U.S. Pat. No. 7,350,902, and is incorporated by reference herein in its entirety. The inkjet printer system 10 includes an image data source 12, which provides data signals that are interpreted by a controller 14 as being commands to eject drops. The controller 14 includes an image processing unit 15 for rendering images for printing and outputs signals to an electrical pulse source 16 of electrical energy pulses that are inputted to an inkjet printhead 100, which includes at least one inkjet printhead die 110.

In the example shown in FIG. 1, there are two nozzle arrays. Nozzles 121 in a first nozzle array 120 have a larger opening area than nozzles 131 in a second nozzle array 130. In this example, each of the two nozzle arrays 120 and 130 has two staggered rows of nozzles 121 and 131, each row having a nozzle density of 600 per inch. The effective nozzle density then in each array is 1200 per inch (i.e. $d=1/1200$ inch in FIG. 1). If pixels on a recording medium 20 were sequentially numbered along the paper advance direction, the nozzles 121, 131 from one row of a nozzle array 120, 130 would print the odd numbered pixels, while the nozzles 121, 131 from the other row of the nozzle array 120,130 would print the even numbered pixels.

In fluid communication with each nozzle array 120 and 130 is a corresponding ink delivery pathway. The ink delivery pathway 122 is in fluid communication with the first nozzle array 120, and an ink delivery pathway 132 is in fluid communication with the second nozzle array 130. Portions of the ink delivery pathways 122 and 132 are shown in FIG. 1 as openings through printhead die substrate 111. One or more inkjet printhead die 110 will be included in the inkjet printhead 100, but for greater clarity only one inkjet printhead die 110 is shown in FIG. 1. The inkjet printhead die 110 are arranged on a mounting substrate member as discussed below relative to FIG. 2. In FIG. 1, a first fluid source 18 supplies ink to the first nozzle array 120 via the ink delivery pathway 122, and a second fluid source 19 supplies ink to the second nozzle array 130 via the ink delivery pathway 132. Although distinct fluid sources 18 and 19 are shown, in some applications it may be beneficial to have a single fluid source supplying ink to both the first nozzle array 120 and the second nozzle array 130 via the ink delivery pathways 122 and 132 respectively. Also, in some embodiments, fewer than two or more than two nozzle arrays 120 and 130 can be included on the printhead die 110. In some embodiments, all nozzles 121 and 131 on the inkjet printhead die 110 can be the same size, rather than having multiple sized nozzles 121 and 131 on the inkjet printhead die 110.

The drop forming mechanisms associated with the nozzles 121, 131 are not shown in FIG. 1. The drop forming mechanisms can be of a variety of types, some of which include a heating element to vaporize a portion of ink and thereby cause ejection of a droplet, or a piezoelectric transducer to constrict the volume of a fluid chamber and thereby cause ejection, or an actuator which is made to move (for example, by heating a bi-layer element) and thereby cause ejection. In any case, electrical pulses from the electrical pulse source 16 are sent to the various drop ejectors according to the desired deposition pattern. In the example of FIG. 1, droplets 181 ejected from the first nozzle array 120 are larger than droplets 182 ejected from the second nozzle array 130, due to the larger nozzle opening area. Typically other aspects of the drop forming mechanisms (not shown) associated respectively with the nozzle arrays 120 and 130 are also sized differently in order to optimize the drop ejection process for the different sized drops. During operation, droplets of ink are deposited on the recording medium 20.

Figure 2:
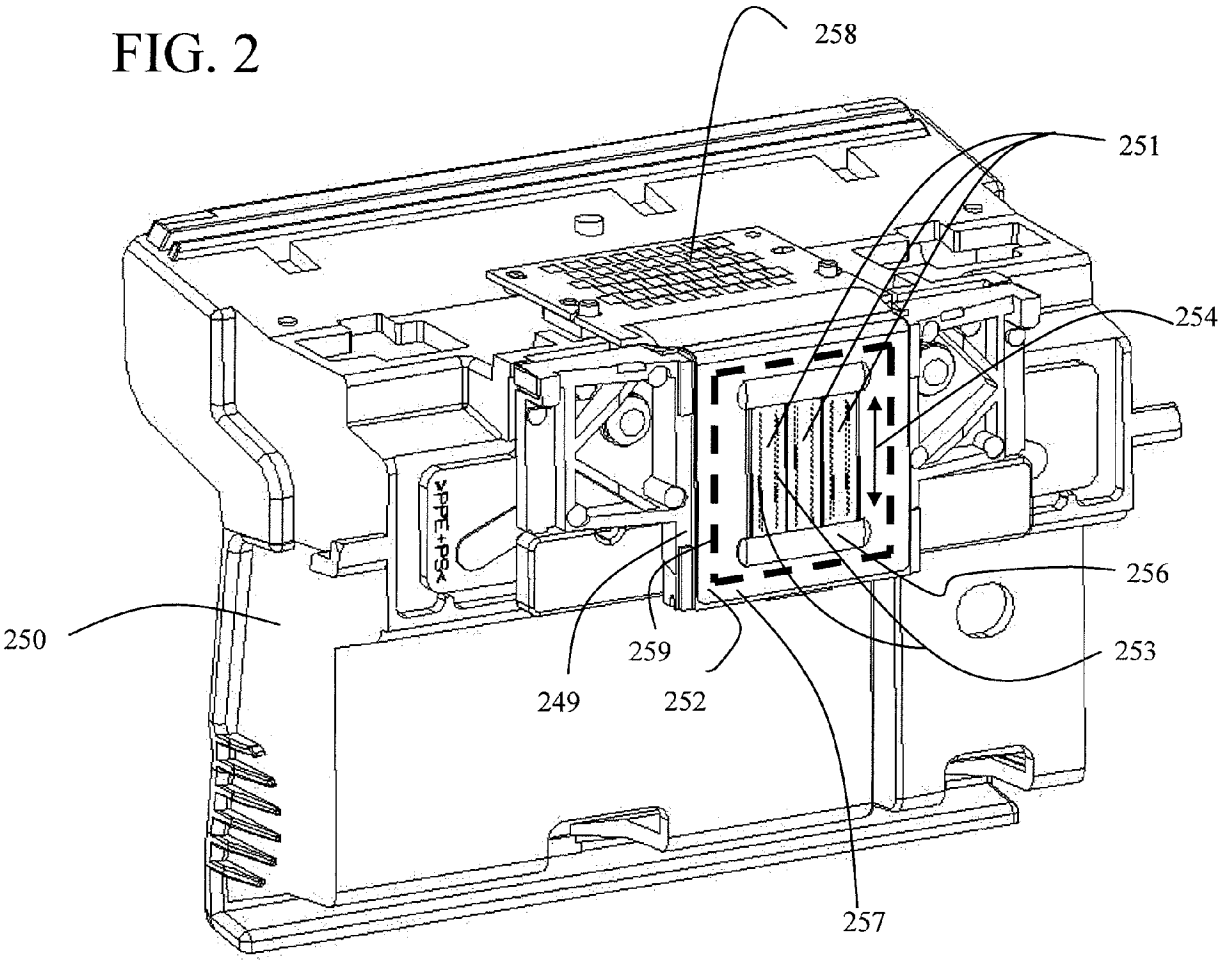
FIG. 2 is a perspective of a portion of a printhead.

FIG. 2 shows a perspective of a portion of a printhead 250, which is an example of an inkjet printhead 100. Printhead 250 includes three printhead die 251 (similar to printhead die 110 in FIG. 1) mounted on a mounting substrate 249, each printhead die 251 containing two nozzle arrays 253, so that the printhead 250 contains six nozzle arrays 253 altogether. For an inkjet printhead, the terms printhead die and ejector die will be used herein interchangeably. The six nozzle arrays 253 in this example can each be connected to separate ink sources (not shown in FIG. 2); such as cyan, magenta, yellow, text black, photo black, and a colorless protective printing fluid. Each of the six nozzle arrays 253 is disposed along a nozzle array direction 254, and the length of each nozzle array 253 along the nozzle array direction 254 is typically on the order of 1 inch or less. Typical lengths of recording media 20 are 6 inches for photographic prints (4 inches by 6 inches) or 11 inches for paper (8.5 by 11 inches). Thus, in order to print a full image, a number of swaths are successively printed while moving the printhead 250 across the recording medium 20 (FIG. 1). Following the printing of a swath, the recording medium 20 is advanced along a media advance direction that is substantially parallel to the nozzle array direction 254.

Figure 5:
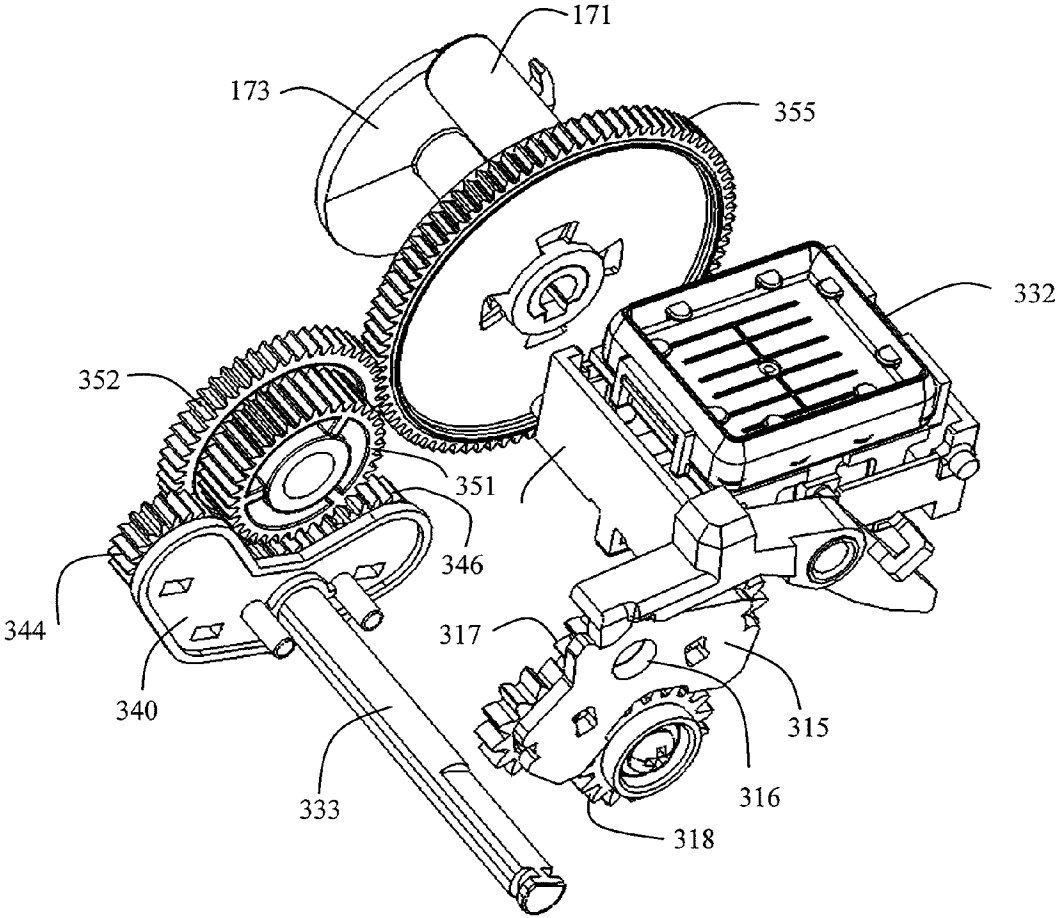
FIG. 5 is a prior art gear train configuration for providing power to a peristaltic pump.

The printhead die 251 are electrically interconnected to a flex circuit 257 on a printhead face 252, for example by wire bonding or TAB bonding. The interconnections are covered by an encapsulating material 256 to protect them. The flex circuit 257 bends around a side of the printhead 250 and connects to a connector board 258. When the printhead 250 is mounted into a carriage 200 (see FIG. 3), the connector board 258 is electrically connected to a connector (not shown) on the carriage 200, so that electrical signals can be transmitted to the printhead die 251. As described below relative to FIGS. 3 and 5 when the printhead 250 is located at a maintenance station 330, a cap 332 makes sealing contact to the printhead face 252 around the printhead die 251 at a capping region 259 indicated by the bold dashed line.

Figure 3:
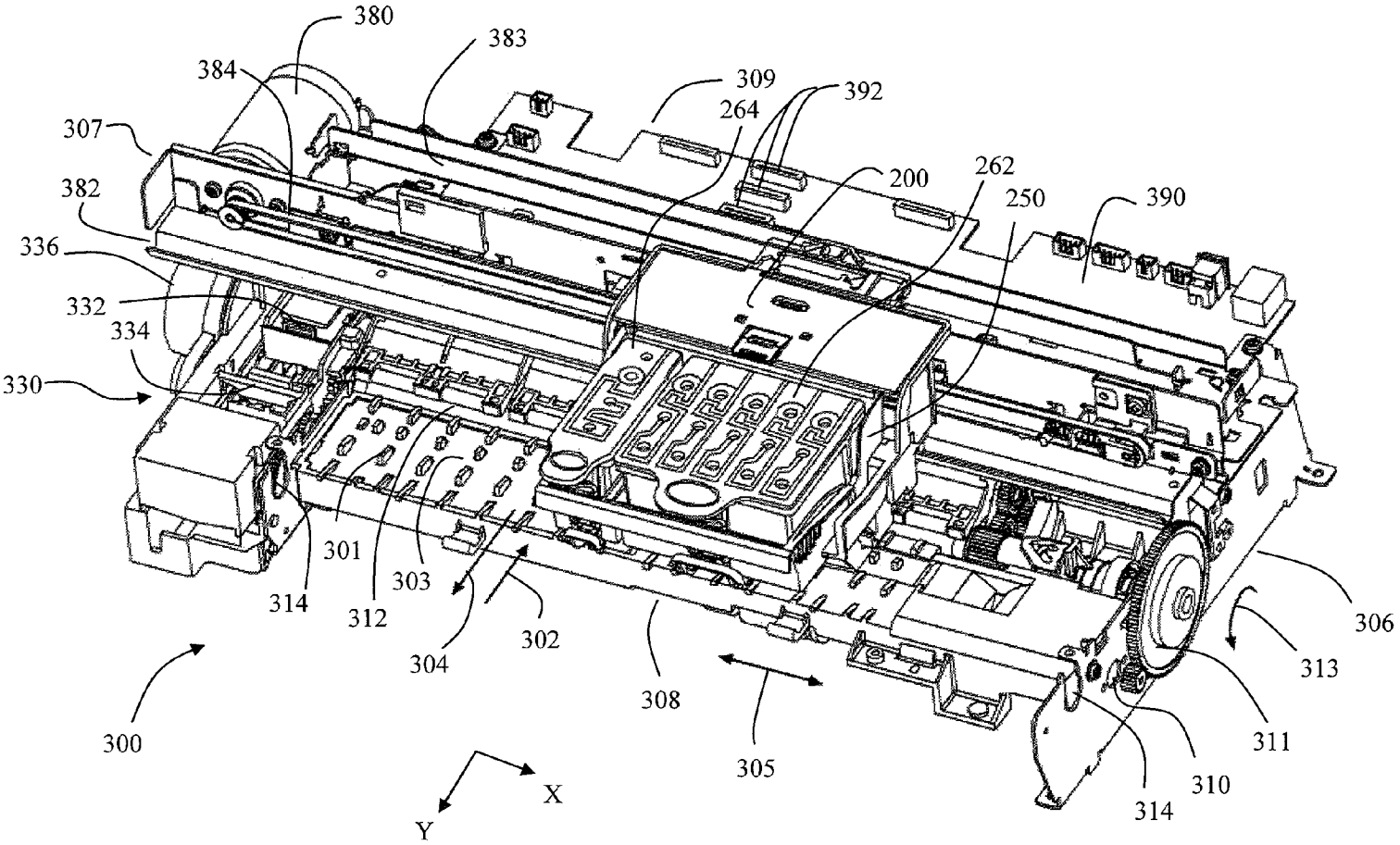
FIG. 3 is a perspective of a portion of a carriage printer.

FIG. 3 shows a portion of a desktop carriage printer. Some of the parts of the printer have been hidden in the view shown in FIG. 3 so that other parts can be more clearly seen. A printer chassis 300 has a print region 303 across which the carriage 200 is moved back and forth in a carriage scan direction 305 along the X axis, between a right side 306 and a left side 307 of printer chassis 300, while drops are ejected from the printhead die 251 (not shown in FIG. 3) on the printhead 250 that is mounted on the carriage 200. A platen 301 (which optionally includes ribs) supports the recording medium 20 (FIG. 1) in the print region 303. A carriage motor 380 moves a belt 384 to move the carriage 200 along a carriage guide 382. An encoder sensor (not shown) is mounted on the carriage 200 and indicates carriage location relative to an encoder fence 383.

The printhead 250 is mounted in the carriage 200, and a multi-chamber ink supply 262 and a single-chamber ink supply 264 are mounted in the printhead 250. The mounting orientation of the printhead 250 is rotated relative to the view in FIG. 2, so that the printhead die 251 are located at the bottom side of the printhead 250, the droplets of ink being ejected downward toward the platen 301 in the print region 303 in the view of FIG. 3. The multi-chamber ink supply 262, in this example, contains five ink sources: cyan, magenta, yellow, photo black, and colorless protective fluid; while the single-chamber ink supply 264 contains the ink source for text black. Paper or other recording medium 20 (sometimes generically referred to as paper or print medium or media herein) is loaded along a paper load entry direction 302 toward the front of the printer chassis 308.

Figure 4:
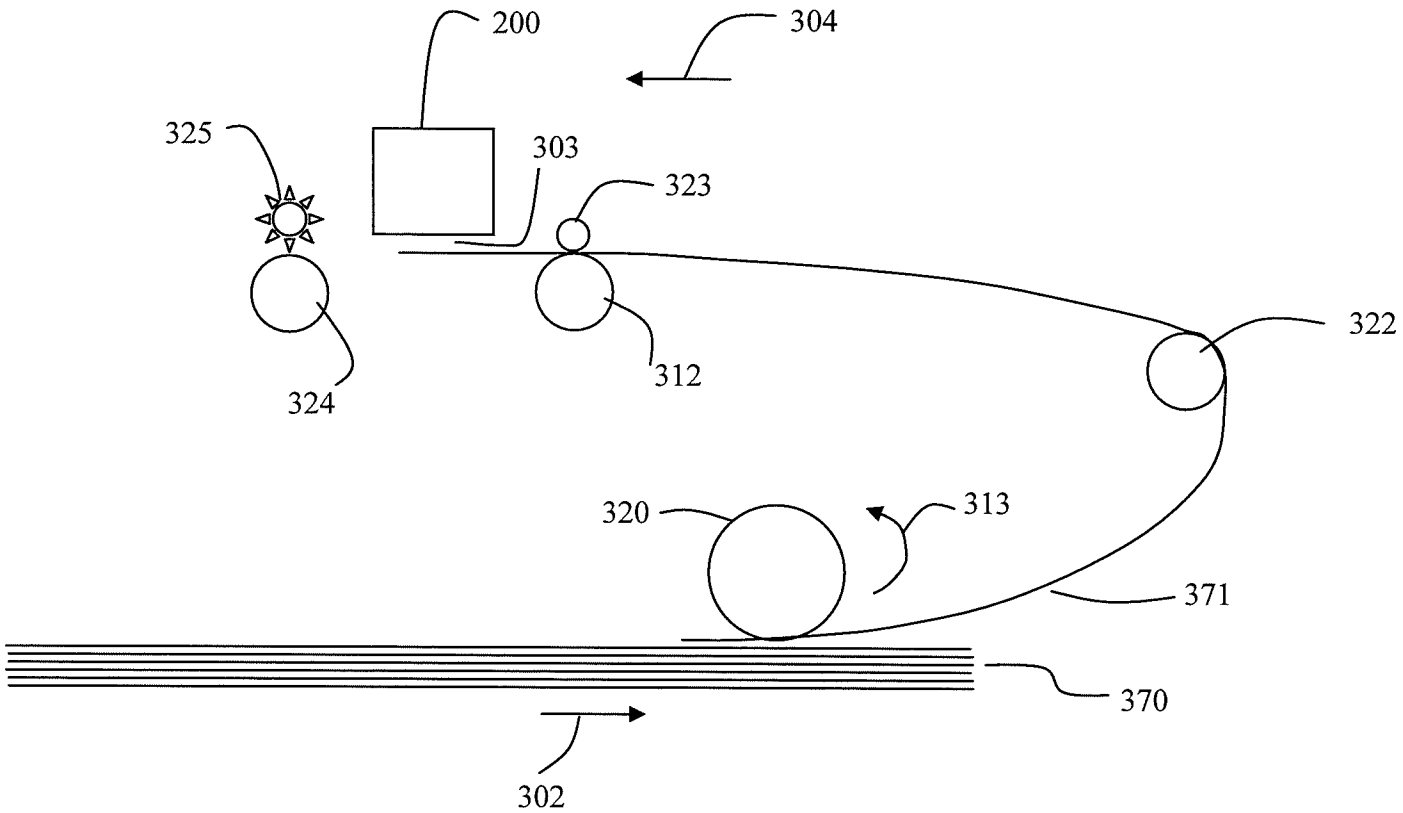
FIG. 4 is a schematic side view of an exemplary paper path in a carriage printer.

A variety of rollers are used to advance the recording medium 20 through the printer as shown schematically in the side view of FIG. 4. In this example, a pick-up roller 320 moves the top piece or sheet 371 of a stack 370 of paper or other recording medium 20 in the direction of arrow, paper load entry direction 302. A turn roller 322 acts to move the paper around a C-shaped path (in cooperation with a curved rear wall surface) so that the paper continues to advance along media advance direction 304 from the rear 309 of the printer chassis (with reference also to FIG. 3). The paper is then moved by a feed roller 312 and idler roller(s) 323 to advance along the Y axis across the print region 303, and from there to an output roller 324 and star wheel(s) 325 so that printed paper exits along the media advance direction 304. The feed roller 312 includes a feed roller shaft along its axis, and a feed roller gear 311 (see FIG. 3) is mounted on the feed roller shaft. The feed roller 312 can include a separate roller mounted on the feed roller shaft, or can include a thin high friction coating on the feed roller shaft. A rotary encoder (not shown) can be coaxially mounted on the feed roller shaft in order to monitor the angular rotation of the feed roller.

Referring to FIG. 3, the motor that powers the paper advance rollers is not shown, but a hole 310 at the right side of the printer chassis 306 is where the motor gear (not shown) protrudes through in order to engage a feed roller gear 311, as well as the gear for the output roller (not shown). Although the output roller 324 is not shown in FIG. 3, the shaft mounts 314 for the shaft of the output roller are shown. Referring to FIG. 4, for normal paper pick-up and feeding, it is desired that all rollers rotate in a forward rotation direction 313. The feed roller 312 is upstream of the printing region 303 and advances recording medium 20 toward the printing region prior to printing. An output roller 324 is downstream of the printing region 303 and is for moving the recording medium 20 away from printing region 303.

Referring back to FIG. 3, toward the rear of the printer chassis 309, in this example, is located an electronics board 390, which includes cable connectors 392 for communicating via cables (not shown) to the printhead carriage 200 and from there to the printhead 250. Also on the electronics board 390 are typically mounted motor controllers for the carriage motor 380 and for the paper advance motor, a processor and other control electronics (shown schematically as the controller 14 and the image processing unit 15 in FIG. 1) for controlling the printing process, and an optional connector for a cable to a host computer.

Toward the left side of the printer chassis 307 is the maintenance station 330 including a prior art cap 332, a wiper 334 and a prior art tube pump 336 (also sometimes called a peristaltic pump herein). The operation of this maintenance station is described in more detail in U.S. Pat. No. 7,988,255, which is incorporated by reference herein in its entirety. The tube pump 336 is driven by a set of gears and shafts as can be understood with reference to prior art FIG. 5. The shaft of feed roller 312 (FIG. 3) extends through a hole 316 in a pivot arm 315 to drive a feed roller pinion 317. Two other gears (unlabelled) on the pivot arm 315 are engaged with feed roller pinion 317 and selectively engage the pivot arm gear 318 depending on whether the feed roller is rotating in a forward direction 313 (FIG. 3) or in a reverse direction. Pivot arm gear 318 transmits power to drive shaft 333 through two gears that are not shown. A drive shaft 333 transmits power to a gear train including a first gear 344, a second gear 346, compound gears 351 and 352, and other gears (not shown) on the other side of a toggle arm 340. An external housing of tube pump 336 (FIG. 3) is hidden in FIG. 5 so that some of the inner workings of the peristaltic pump can be seen. In particular, the compound gear 352 drives a pump cam gear 355 to rotate pump roller cam 173. The pump roller cam 173 pushes a pump roller 171 into rolling engagement with flexible tubing (not shown) to compress the flexible tubing against an inner surface of the housing (not shown) thereby producing a suction. One end of the flexible tubing (not shown) goes to a cap 332 to provide a suction force that can be used either to suck on the nozzles 121, 131 of printhead 250 when cap 332 is sealed around the capping region 259 (FIG. 2) on the printhead face 252 of the printhead 250, or to discharge excess ink from the cap through the other end of the flexible tubing (not shown). The numerous gears required in prior art FIG. 5 to drive the tube pump can cause noise, take up space, and reduce the driving efficiency due to friction in the gears. In addition, it can require multiple cycles of the pump roller 171 against the flexible tubing in order to generate sufficient suction for priming the printhead 250.

Figure 6:
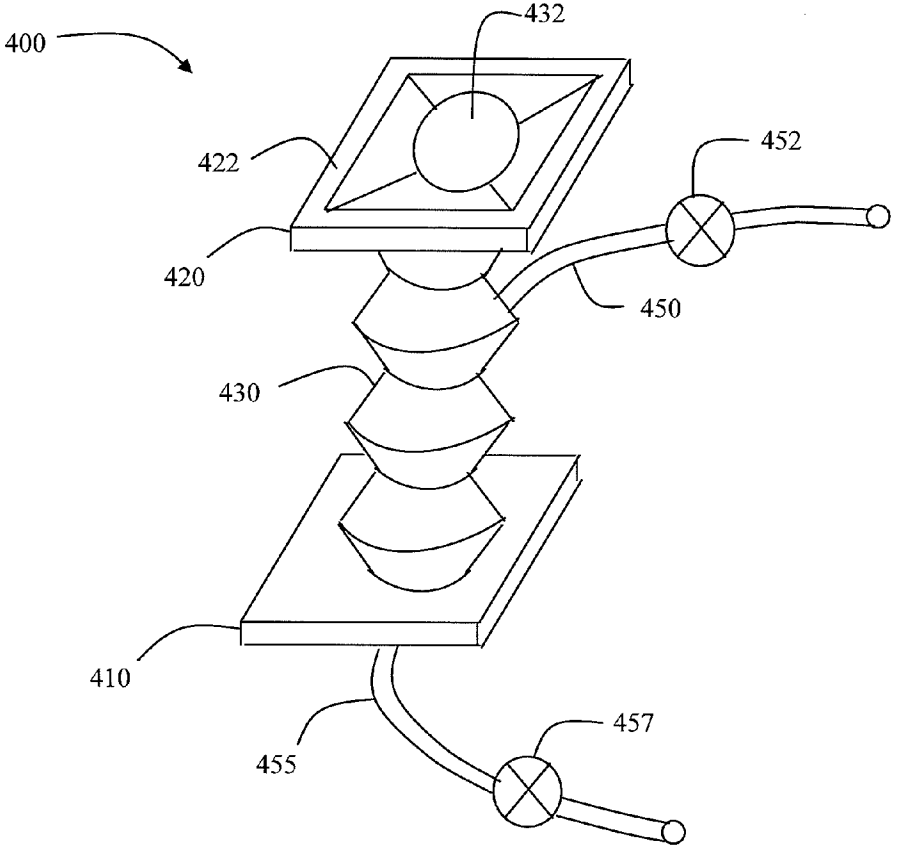
FIG. 6 is a perspective of a pumping cap according to an embodiment of the invention

Embodiments of the present invention replace the prior art cap 332 and the tube pump 336 with, as shown in FIG. 6, a pumping cap 400 having a cap base 410, a frame 420 having a sealing face 422 for making sealing contact around the printhead face 252 at the capping region (FIG. 2), and a compressible portion 430 located between the cap base 410 and the sealing face 422. The compressible portion 430 can be a bellows having an internal spring (not shown) that tends to expand the bellows. The bellows-shaped compressible wall of the compressible portion 430 has a first diameter D1 (FIG. 7) and a second diameter D2 (FIG. 7) that is less than the first diameter. An opening 432 in the compressible portion 430 is included within the frame 420 and a vent line 450 connects the compressible portion 430 to ambient through a vent valve 452. A drain line 455 is connected to the bottom of the compressible portion 430 and allows gravity draining of waste ink onto a waste pad (not shown) when a drain valve 457 is in its open position. When the sealing face 422 is sealed around the capping region 259 of the printhead face 252 and the cap base 410 is moved toward the frame 420, thereby compressing the compressible portion 430 while the vent valve 452 is in its open position, air is expelled from the pumping cap 400 through the vent line 450 without generating excess pressure at the printhead face 252. Subsequently, as the cap base 410 is moved away from the frame 420 while both the vent valve 452 and the drain valve 457 are closed and the sealing face 422 remains in sealing contact with the capping region 259, the pressure inside the pumping cap 400 is reduced as the volume of the compressible portion 430 expands, thereby applying suction to the printhead face 252 (FIG. 2).

Figure 7:
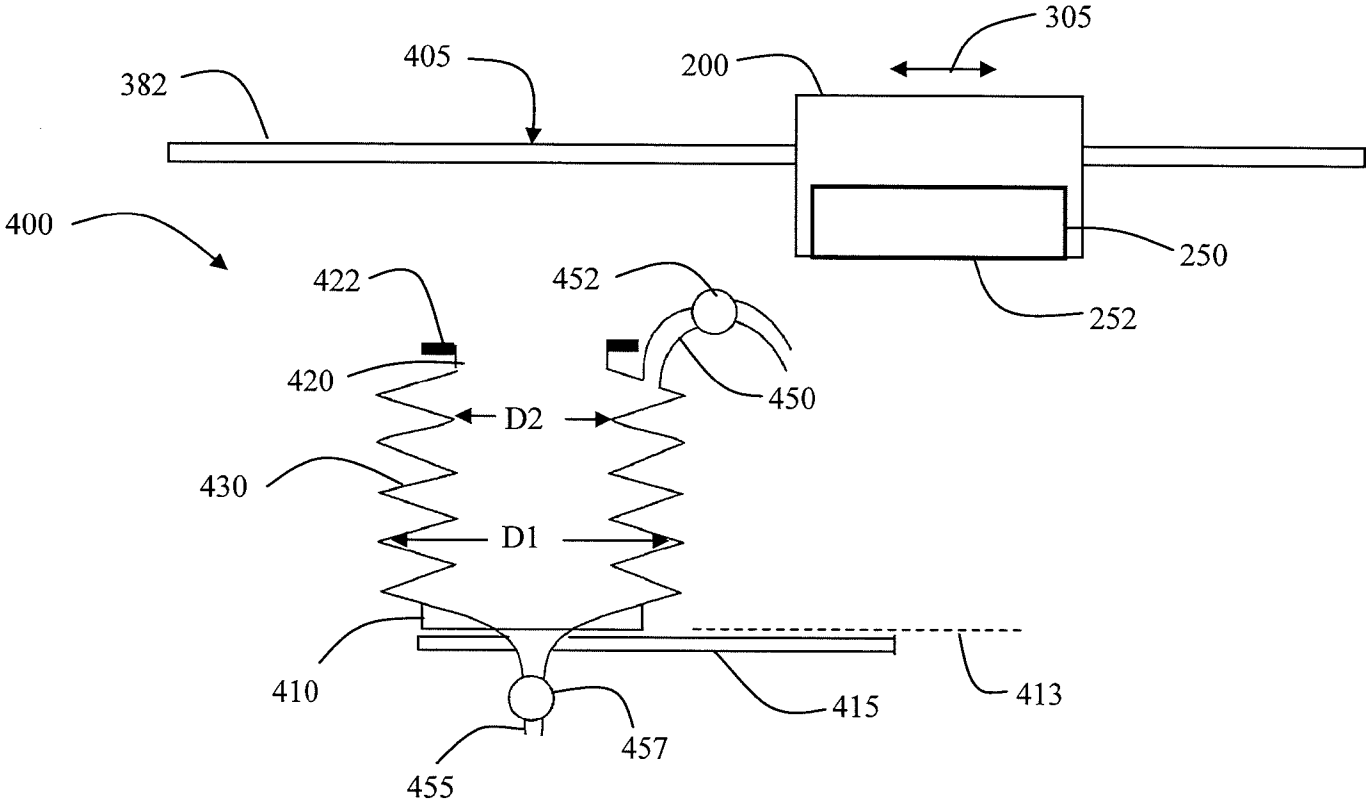
FIG. 7 shows a side view of a carriage moving a printhead toward the pumping cap.

FIG. 7 shows a side view of the carriage 200 moving the printhead 250 along the carriage guide 382 in the carriage scan direction 305. The pumping cap 400 is located at a home position 405 of the printhead 250. The printhead 250 is parked at the home position 405 between print jobs. When the printhead 250 is parked at the home position 405, a cap base elevator 415 moves the cap base 410 toward the printhead face 252, which also moves the frame 420 and the sealing face 422 toward the printhead face 252. The cap base elevator 415 can be actuated by motion of the carriage 200, or by the paper advance motor (not shown) or by some other motor in the printer. Similarly, when the printhead 250 is moved out of the home position 405, the cap base elevator 415 retracts to move the cap base 410, the sealing face 422 and the frame 420 away from the printhead face 252 to the position shown in FIG. 7. This position, also called the third position 413 of the cap base 410, moves the pumping cap 400 out of the way of the moving the carriage 200 and results in the sealing face 422 being spaced apart from the printhead face 252.

Figure 8C:
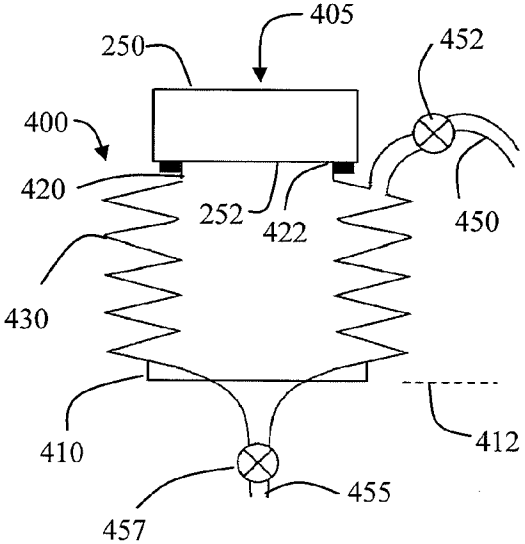
FIGS. 8A to 8C show successive states of the pumping cap as it generates suction on the printhead face.
Figure 8B:
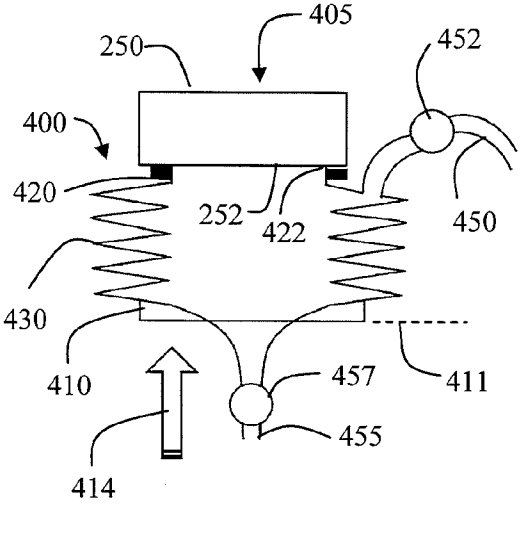
Figure 8A:
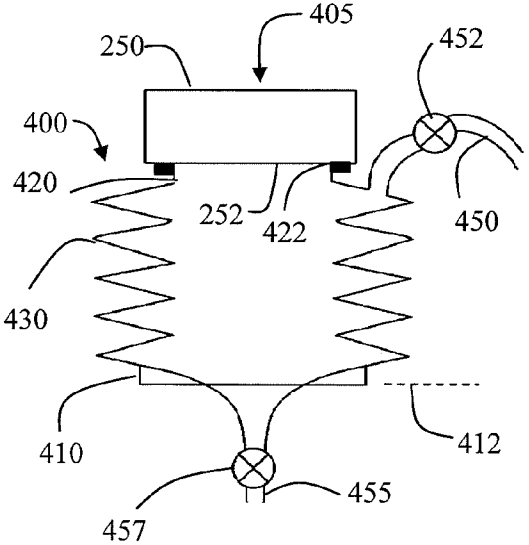

FIGS. 8A, 8B and 8C show three successive states of the pumping cap 400 as it generates suction on the printhead face 252 for priming, i.e. removing air bubbles and some ink from the nozzle arrays 253 (FIG. 2) while the printhead 250 is in the home position 405. In FIG. 8A the cap base 410 has been moved from third position 413 (FIG. 7) to the second position 412, which is closer to the printhead face 252 than third position 413 is. The sealing face 422 is sealed against the printhead face 252. The vent valve 452 and the drain valve 457 are both in their closed positions (as indicated by the X) so that the printhead face 252 is isolated from ambient. This is the configuration of the pumping cap 400 during capping of the printhead 250 to hinder evaporation of volatiles of the ink from the nozzles 121, 131. Optionally, the vent valve 452 or the drain valve 457 or both can be opened to allow communication between the internal atmosphere of the pumping cap 400 and the ambient atmosphere surrounding the pumping cap 400 when it is desirable to vent the pumping cap 400 to prevent evaporative pressure from pushing air into the nozzles 121, 131 during long term printhead storage.

In FIG. 8B the cap base 410 has been moved by the cap base elevator 415 (FIG. 7) from the second position 412 to the first position 411, which is at a smaller distance from the sealing face 422 than the second position 412. As the cap base 410 moves toward the sealing face 422 along a compression direction 414, the compressible portion 430 is compressed. At least one of the vent valve 452 and the drain valve 457 are opened during compression, so that air is expelled through the vent line 450 and the drain line 455, depending on which valve or valves are open, thereby relieving excess pressure in the cap that would otherwise be applied to the printhead face 252. (Both valves 452 and 457 are shown in their open positions in FIG. 8B.) If the drain valve 457 is opened, waste ink that has accumulated in the pumping cap 400 is removed through the drain line 455 by gravity and disposed in a waste pad (not shown).

In order to apply suction to the printhead face 252, the vent valve 452 and the drain valve 457 are set to their closed positions and the cap base elevator 415 moves the cap base 410 from the first position 411 to the second position 412 (in a direction away from the printhead face 252), while the sealing face 422 is held against the printhead face 252. As the compressible portion 430 expands with the valves 452 and 457 closed, suction pressure is generated within the pumping cap 400 for removing air bubbles and some ink from the nozzle arrays 253 (FIG. 2). For good control of the suction pressure versus time, the velocity of the cap base 410 can be controlled, for example by the controller 14 (FIG. 1). Optionally, the vent valve 452 can be opened briefly after the cap base 410 is moved from the first position 411 to the second position 412 to stop the suction pressure on the printhead face 252 after priming, before closing the vent valve 452 again to isolate the printhead face 252 from ambient. FIG. 8C is substantially the same as FIG. 8A, so the printhead 250 can remain in its capped state. Alternatively, the cap base elevator 415 can move the cap base 410 into the third position 413 (FIG. 7) so that the printhead 250 can be moved away from home position.

Figure 9:
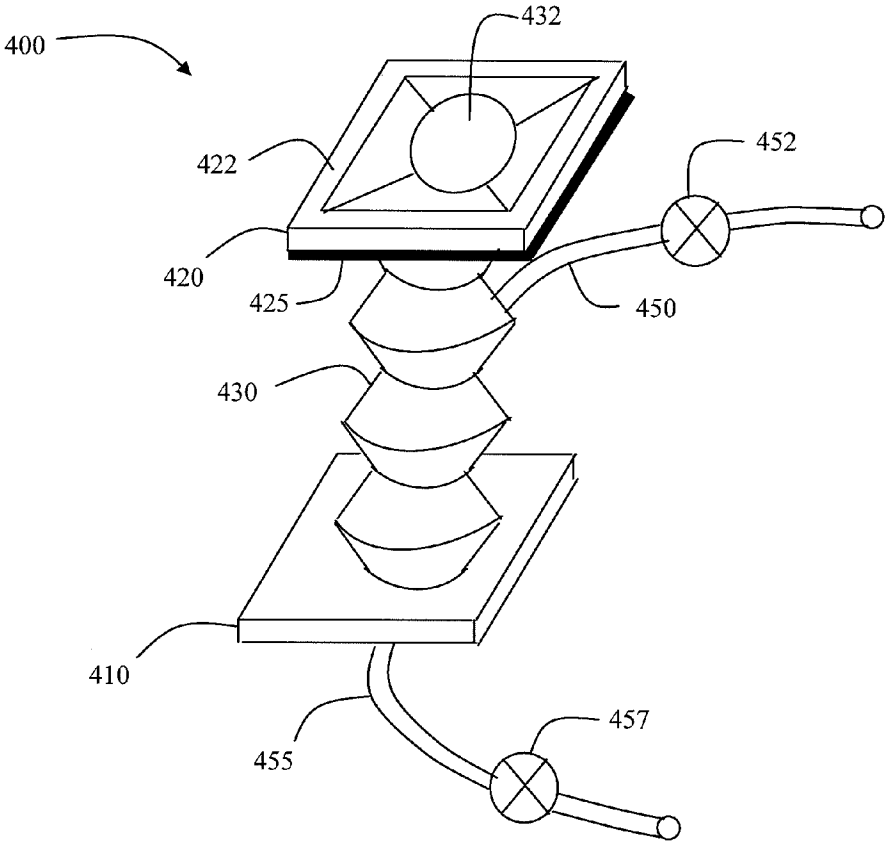
FIG. 9 shows a first embodiment of a holding mechanism for holding the sealing face of the pumping cap against the printhead face.

As the cap base elevator 415 moves the cap base 410 away from the first position 411 to the second position 412, it can be advantageous to physically hold the sealing face 422 of the pumping cap 400 against the printhead face 252 so that suction is generated in the pumping cap 400, rather than simply pulling the sealing face 422 away from the printhead face 252. FIG. 9 shows a first embodiment of a holding mechanism in which a permanent magnet 425 is mounted below the frame 420 near the sealing face 422. In this embodiment, an electromagnet is mounted on the printhead 250 below the flex circuit 257 in a position corresponding to the capping region 259. When the electromagnet is turned on, the permanent magnet 425 is attracted toward the printhead face 252, thereby holding the sealing face 422 against the printhead face 252. The electromagnet is turned off when it is desired to move the sealing face 422 away from the printhead face 252.

Figure 10:
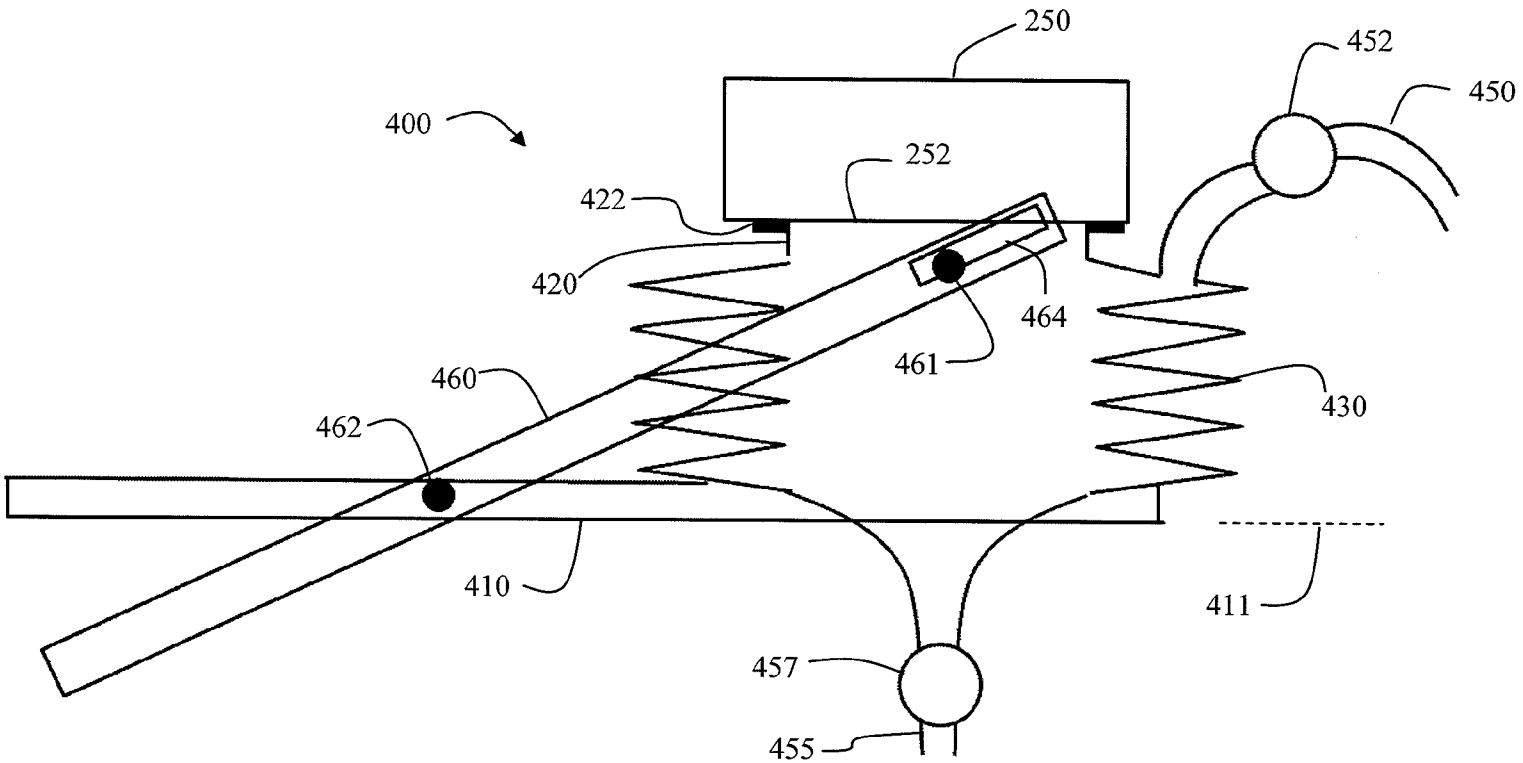
FIGS. 10 and 11 show a second embodiment of a holding mechanism for holding the sealing face of the pumping cap against the printhead face.
Figure 11:
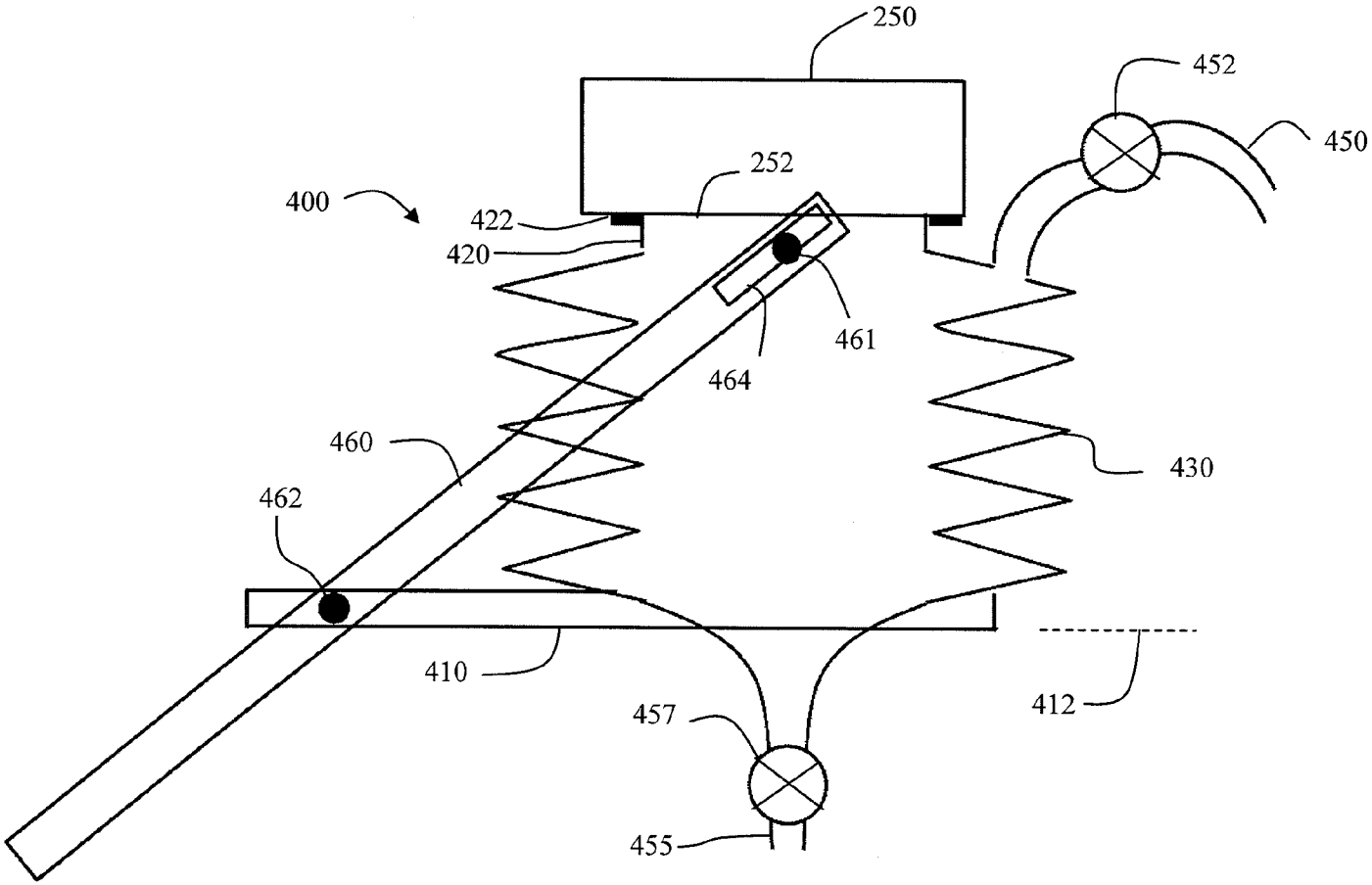

A second type of holding mechanism is shown in the side views of FIGS. 10 and 11. In this second embodiment, a lever arm 460 is pivotably attached to the cap base 410 by a first pin 461. The lever arm 460 includes a slot 464 through which a second pin 462 extends, thereby slidingly attaching the lever arm 460 to the frame 420. Optionally, the end of the lever arm 460 near the frame 420 is shaped like a two pronged fork, so that another pin (not shown) on the opposite side of the frame 420 also slidingly attaches the lever arm 460 to the frame 420. Motion of the lever arm 460 controls the distance between the cap base 410 and the frame 420. In FIG. 10, the cap base 410 is at its first position 411 and the compressible portion 430 is compressed. In FIG. 11, the cap base 410 is at its second position 412 so that the compressible portion 430 is not compressed. The vent valve 452 and the drain valve 457 are shown in their closed positions in FIG. 10 so that a suction pressure is generated in the pumping cap 400 while the sealing face 422 is held against the printhead face 252.

In a third embodiment of a holding mechanism, the spring force of the compressible portion 430 of the pumping cap 400 is used to force the sealing face 422 against printhead face 252 as the cap base 410 is moved from its first position 411 (FIG. 8B) to its second position 412 (FIG. 8C). In this third embodiment the distance between the sealing face 422 and the cap base 410 when the compressible portion 430 is fully extended is greater than the distance from the sealing face 422 to the second position 412 of the cap base 410, so that the compressible portion 430 remains under compression even when the cap base 410 is located at second position 412. Another way of stating this is that the difference in length of the compressible portion 430 in its fully extended state relative to its fully compressed state is greater than the distance between the first position 411 and the second position 412 of cap base 410. In addition, the difference in length of the compressible portion 430 in its fully extended state relative to its fully compressed state should be less than the distance between the first position 411 and the third position 413 of cap base 410 (FIG. 7), so that the sealing face 422 can be disengaged from the printhead face 252.

If it is not desired to generate suction on the printhead face 252 as the cap base 410 is being moved away from sealing face 422, in some embodiments, the holding mechanism can be deactivated so that the sealing face 422 is not held against the printhead face 252. For example, the electromagnet can be turned off in the first embodiment of the holding mechanism described above, or alternatively the voltage polarity for the electromagnet can be reversed to repel the sealing face 422 from the printhead face 252. Similarly, if it is desired to generate a smaller amount of suction, the electromagnet can be turned off or the voltage polarity can be reversed after the cap base 410 has moved only part of the way from the first position 411 to the second position 412. Also, the vent valve 452 can be opened before the cap base 410 is moved away from the sealing face 422 if it is not desired to generate suction on the printhead face 252.

Figure 12:
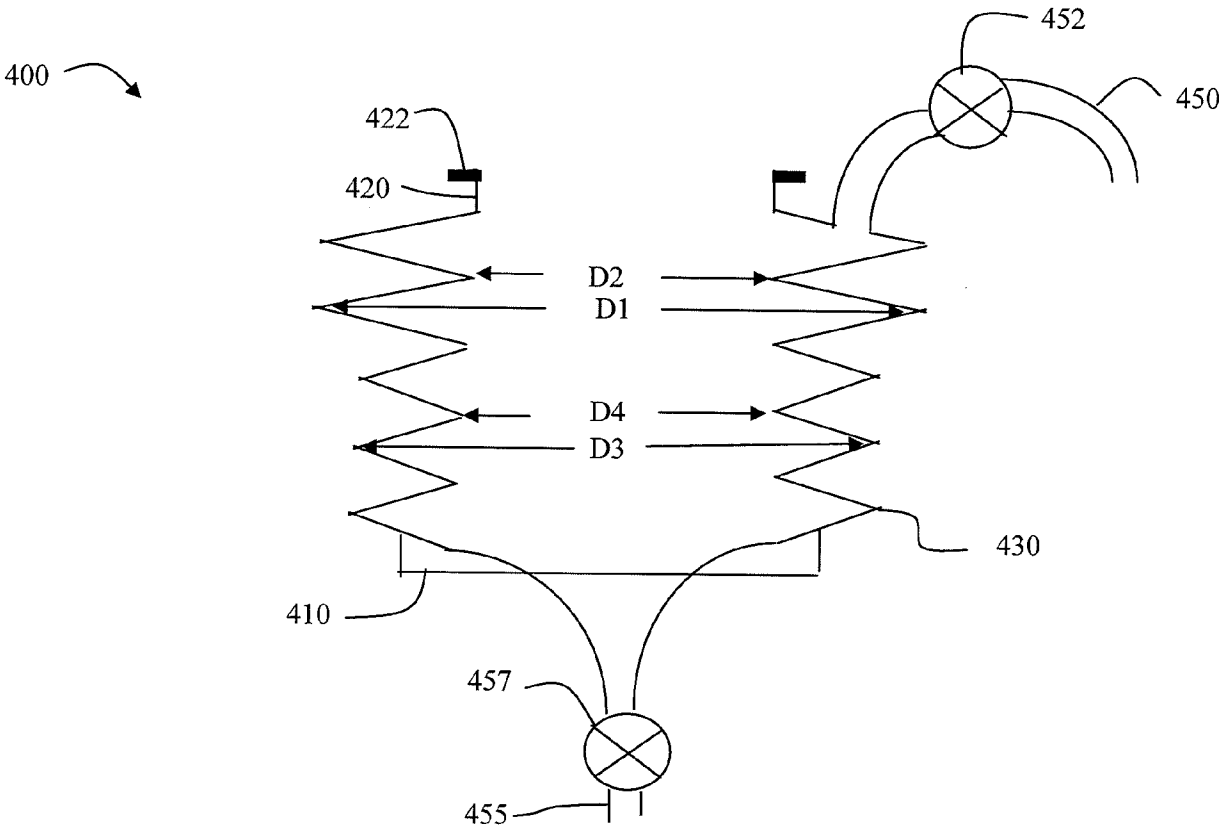
FIG. 12 shows an embodiment of a pumping cap having a variable cross-sectional area of the compressible portion.

The amount of suction pressure generated by the pumping cap 400 depends upon the expansion in volume of the compressible portion 430 as the cap base 410 is moved from the first position 411 (FIG. 8B) to the second position 412 (FIG. 8C). This depends upon the cross-sectional area of the compressible portion 430 as well as the height difference between the first position 411 and the second position 412. In some embodiments as shown in FIG. 7, the compressible portion 430 has a substantially constant cross section with a first diameter D1 and a second diameter D2. In other embodiments, such as that shown in FIG. 12, the compressible portion 430 has at least two different regions with different cross-sectional areas. The compressible wall in a first region near the sealing face 422 is characterized by a first diameter D1 and a second diameter D2, while the compressible wall near the cap base 410 is characterized by a third diameter D3 and a fourth diameter D4, such that D3 does not equal D1, so that the two regions have different cross-sectional areas. Optionally, D2 can also not equal D4. In the example of FIG. 12 the region near the sealing face 422 has a larger cross-sectional area than the region near the cap base 410. Other embodiments (not shown) are contemplated where the region near the cap base 410 has the larger cross-sectional area.

The pumping cap 400 is compatible with other types of maintenance operations as well. For example, drop ejectors in the inkjet printhead can be activated to eject drops into the pumping cap 400 on an as needed basis.

The invention has been described in detail with particular reference to certain preferred embodiments thereof, but it will be understood that variations and modifications can be effected within the scope of the invention.

PARTS LIST

10 Inkjet printer system
12 Image data source
14 Controller
15 Image processing unit
16 Electrical pulse source
18 First fluid source
19 Second fluid source
20 Recording medium
100 Inkjet printhead
110 Inkjet printhead die
111 Substrate
120 First nozzle array
121 Nozzle(s)
122 Ink delivery pathway (for first nozzle array)
130 Second nozzle array
131 Nozzle(s)
132 Ink delivery pathway (for second nozzle array)
171 Pump roller
123 Pump roller cam
181 Droplet(s) (ejected from first nozzle array)
182 Droplet(s) (ejected from second nozzle array)
200 Carriage
249 Mounting substrate
250 Printhead
251 Printhead die (or ejector die)
252 Printhead face
253 Nozzle array
254 Nozzle array direction
256 Encapsulating material
257 Flex circuit
258 Connector board
259 Capping region
262 Multi-chamber ink supply
264 Single-chamber ink supply
300 Printer chassis
301 Platen
302 Paper load entry direction
303 Print region
304 Media advance direction
305 Carriage scan direction
306 Right side of printer chassis
307 Left side of printer chassis
308 Front of printer chassis
309 Rear of printer chassis
310 Hole (for paper advance motor drive gear)
311 Feed roller gear
312 Feed roller
313 Forward rotation direction (of feed roller)
314 Shaft mount (for output roller)
315 Pivot arm
316 Hole
317 Feed roller pinion
318 Pivot arm gear
320 Pick-up roller
322 Turn roller
323 Idler roller
324 Output roller
325 Star wheel(s)
330 Maintenance station
332 Cap (prior art)
333 Shaft
334 Wiper
336 Tube pump (prior art)
340 Toggle arm
344 First gear
346 Second gear
351 Compound gear
352 Compound gear
355 Pump cam gear

370 Stack of media
371 Top piece of medium
380 Carriage motor
382 Carriage guide
383 Encoder fence
384 Belt (carriage)
390 Printer electronics board
392 Cable connectors
400 Pumping cap
405 Home position
410 Cap base
411 First position
412 Second position
413 Third position
414 Compression direction
415 Cap base elevator
420 Frame
422 Sealing face
425 Permanent magnet
430 Compressible portion (bellows)
432 Opening
450 Vent line
452 Vent valve
455 Drain line
457 Drain valve
460 Lever arm
461 First pin
462 Second pin
464 Slot
D1 $1^{st}$ diameter
D2 $2^{nd}$ diameter
D3 $3^{rd}$ diameter
D4 $4^{th}$ diameter

The invention claimed is:

1. An inkjet printer comprising:

an inkjet printhead including nozzles disposed in a printhead face;

a cap including:

a base; and a sealing face for sealing around the printhead face, wherein suction is generated at the printhead face for priming the nozzles when the base is moved from a first position to a second position, wherein the first position is located a smaller distance from the sealing face than the second position;

a valve having an open position and a closed position, wherein the valve is configured to be in the open position when the base of the cap is moved from the second position to the first position for relieving excess pressure in the cap; and a drain line connected to the cap for removing waste liquid from the cap.

2. The inkjet printer of claim 1, wherein the base of the cap has a third position where it is moved to when the printhead is moved away from the cap.

3. The inkjet printer of claim 2, wherein the valve is configured to be in the closed position when the base of the cap is moved from the first position to the second position.

4. The inkjet printer of claim 2, further comprising a compressible portion, wherein a difference in length of the compressible portion in its fully extended state relative to its fully compressed state is less than a distance between the first position and the third position of the base of the cap.

5. The inkjet printer of claim 1, further comprising a holding mechanism for holding the sealing face of the cap in contact with the nozzle face when the base is moved from the first position to the second position.

6. The inkjet printer of claim 5, wherein the holding mechanism includes:

a lever that is pivotably attached to the base of the cap.

7. The inkjet printer of claim 5, wherein the holding mechanism includes an electromagnet.

8. The inkjet printer of claim 7, wherein the electromagnet is mounted on the inkjet printhead proximate the printhead face.

9. The inkjet printer of claim 8, wherein the cap further includes a permanent magnet disposed proximate the sealing face.

10. The inkjet printer of claim 1, the valve being a first valve having an open position and a closed position, the inkjet printer further comprising a second valve having an open position and a closed position, wherein the first valve and the second valve are configured to be in the closed position when the base of the cap is moved from the first position to the second position for generating suction pressure in the cap.

11. The inkjet printer of claim 1, further comprising:

a home position where the inkjet printhead is parked between print jobs, wherein the cap is located at the home position; and an elevating mechanism configured to move the cap base toward the printhead face when the inkjet printhead is moved to the home position and away from the printhead face when the inkjet printhead is moved out of the home position.

12. The inkjet printer of claim 1, wherein an elevating mechanism is further configured to move the cap base away from the printhead face while the inkjet printhead is in a home position for generating suction at the printhead face.

13. The inkjet printer of claim 1, further comprising a compressible portion, wherein a difference in length of the compressible portion in its fully extended state relative to its fully compressed state is greater than a distance between the first position and the second position of the base of the cap.

14. An inkjet printer comprising:

an inkjet printhead including nozzles disposed in a printhead face;

a cap including:

a base;

a sealing face for sealing around the printhead face, wherein suction is generated at the printhead face for priming the nozzles when the base is moved from a first position to a second position, wherein the first position is located a smaller distance from the sealing face than the second position; and a bellows-shaped compressible wall including:

a first portion proximate the sealing face, the first portion having at least a first portion inner corner and a first portion outer corner which first portion outer corner includes a first maximum diameter; and a second portion proximate the base, the second portion having at least a second portion inner corner and a second portion outer corner which second portion outer corner includes a second maximum diameter that is not equal to the first maximum diameter; and a valve having an open position and a closed position, wherein the valve is configured to be in the open position when the base of the cap is moved from the second position to the first position for relieving excess pressure in the cap.

* * * * *